United States Patent [19]

Garrett

[11] Patent Number: 5,065,146

[45] Date of Patent: Nov. 12, 1991

[54] MANUALLY-OPERATED CONTROL DEVICE

[75] Inventor: Michael J. Garrett, Otterbourne, England

[73] Assignee: International Business Machines Corporation, Armonk, N.Y.

[21] Appl. No.: 617,288

[22] Filed: Nov. 19, 1990

Related U.S. Application Data

[63] Continuation of Ser. No. 208,699, Jun. 20, 1988, abandoned.

[30] Foreign Application Priority Data

Jun. 18, 1987 [GB] United Kingdom ..... 8714334

[51] Int. Cl.[5] ..... G09G 3/02

[52] U.S. Cl. ..... 340/709; 340/706; 341/31; 273/148 B; 250/221

[58] Field of Search ..... 340/706, 709; 341/31; 273/148 B; 74/471 XY; 250/221

[56] References Cited

U.S. PATENT DOCUMENTS

| | | | |
|---|---|---|---|
| 4,313,227 | 1/1982 | Eder | 340/709 |
| 4,533,827 | 8/1985 | Fincher | 250/221 |
| 4,534,668 | 8/1985 | Hildel et al. | 341/31 |
| 4,584,510 | 4/1986 | Hollow | 250/221 |
| 4,686,361 | 8/1989 | Bard | 250/221 |
| 4,731,530 | 3/1988 | Mikan | 340/709 |
| 4,748,323 | 5/1988 | Holiday | 250/221 |
| 4,766,306 | 8/1988 | Bichsel et al. | 341/31 |
| 4,829,165 | 5/1989 | Kalawsky | 341/31 |
| 4,856,785 | 8/1989 | Lantz et al. | 250/221 |

FOREIGN PATENT DOCUMENTS

| | | |
|---|---|---|
| 0083421 | 3/1981 | European Pat. Off. . |
| 2909578 | 10/1979 | Fed. Rep. of Germany . |
| 3300271 | 7/1984 | Fed. Rep. of Germany . |
| 8004928 | 8/1980 | Netherlands . |
| 1523679 | 9/1978 | United Kingdom . |
| 2020010 | 11/1979 | United Kingdom . |

OTHER PUBLICATIONS

M. W. Carmichael "Coded Sphere Joystick"—IBM Technical Disclosure Bulletin—vol. 19, No. 6—Nov./76, pp. 2226–2227.

IBM Technical Disclosure Bulletin, vol. 27, No. 8, Jan. 1985, pp. 4732–4733.

*Primary Examiner*—Jeffery A. Brier
*Assistant Examiner*—M. Fatahiyar
*Attorney, Agent, or Firm*—Martin J. McKinley

[57] ABSTRACT

A joystick for moving a cursor on a display screen uses an infrared transmitter (34) radiating into a transparent handle (14). As the handle is moved by an operator, infra-red light is directed to one of four optical detectors (31) covering up, down, left and right directions respectively. The device can also detect movement at 45 degrees to any of these directions since light is then directed to two detectors (31). A further four optical detectors (31*a*) are provided, each arranged adjacent one of the first four detectors (31), so that further movement of the handle in the same direction can be detected. An additional optical detector (37) is arranged to detect downward movement of the handle (14) against a spring (24). The handle is translatably mounted, rather than pivotally mounted as in a stand joystick.

7 Claims, 5 Drawing Sheets

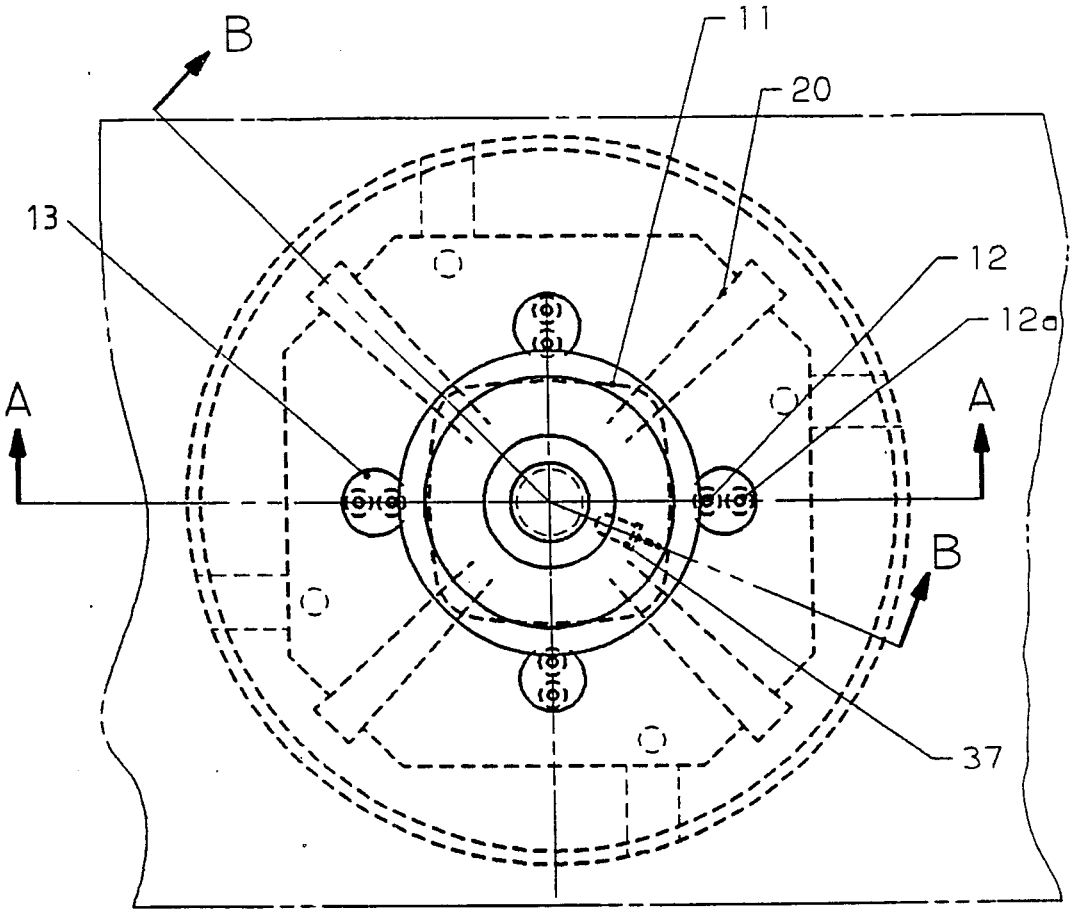
FIG 2
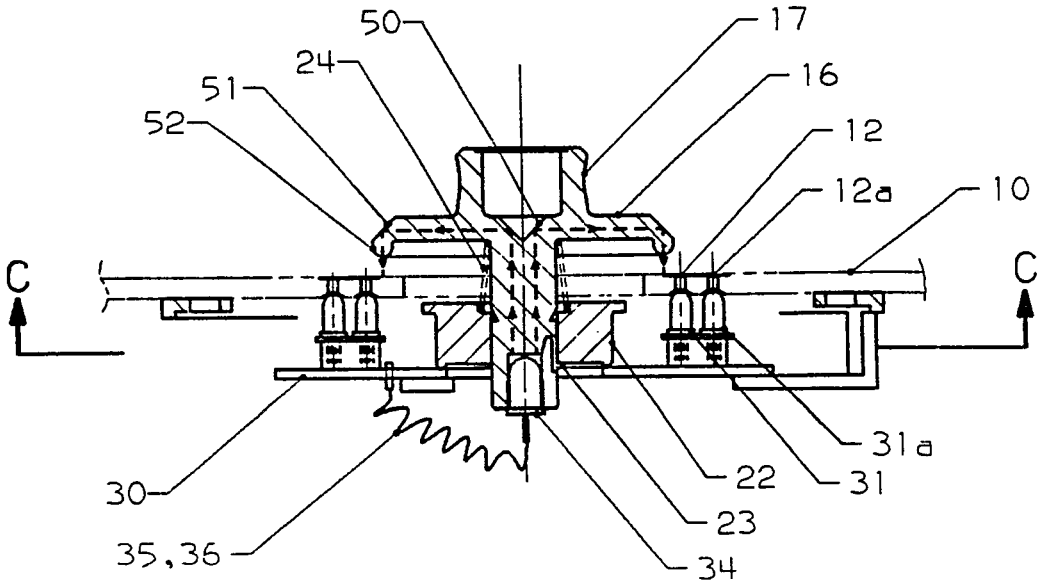
SECTION A-A - FIG 3

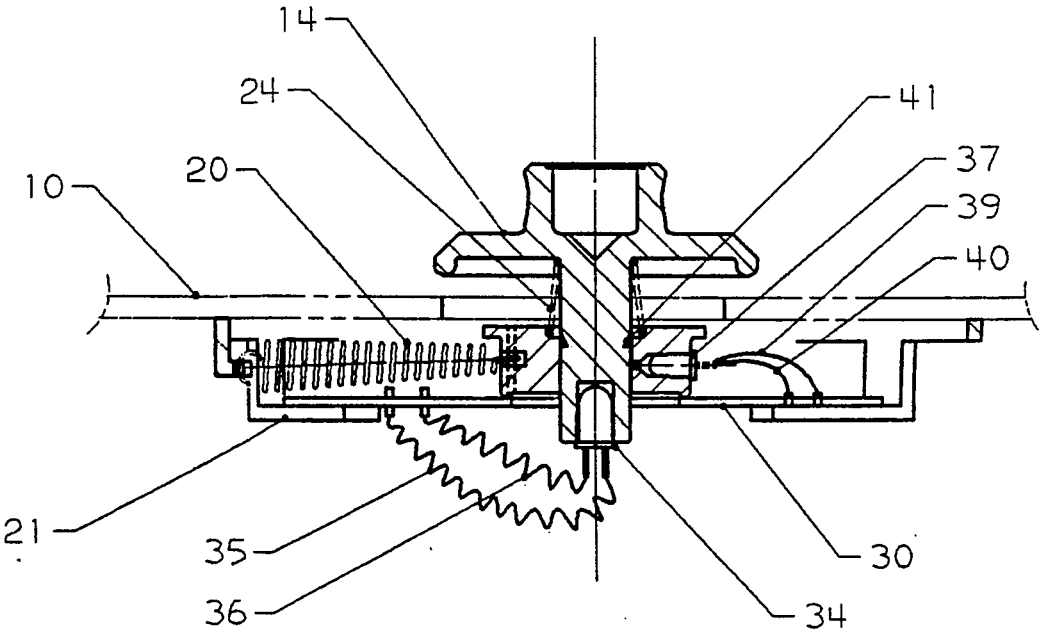
SECTION B-B - FIG 4
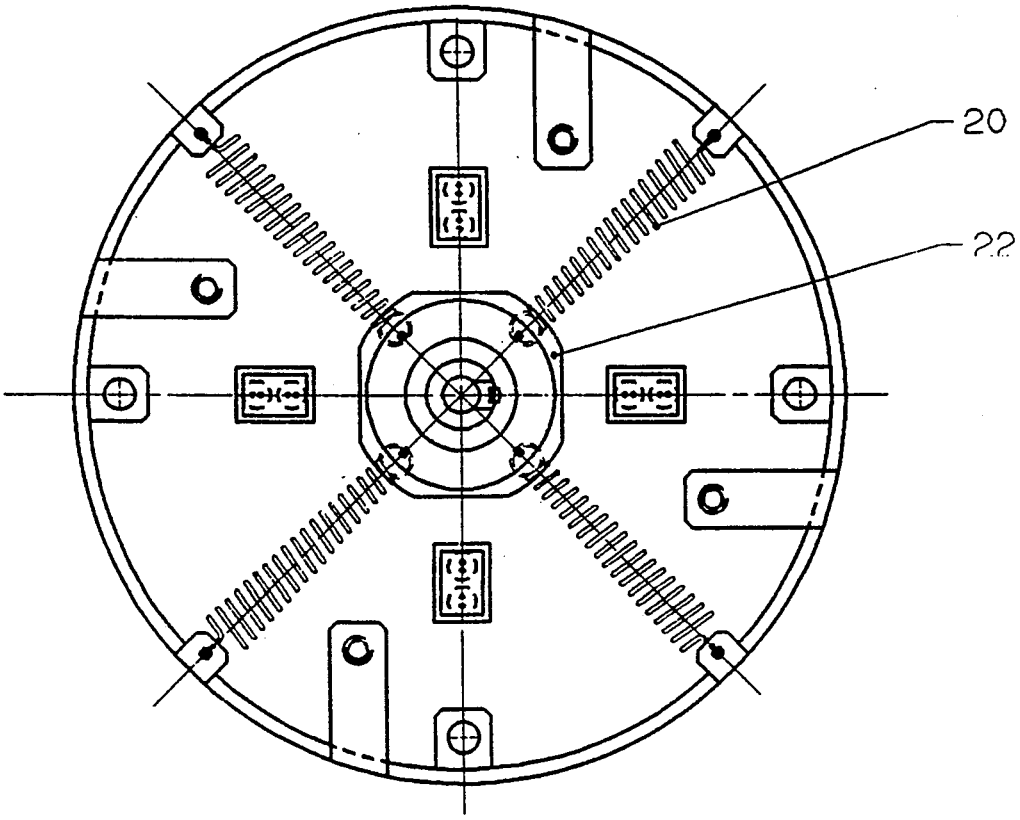
SECTION C-C - FIG 5

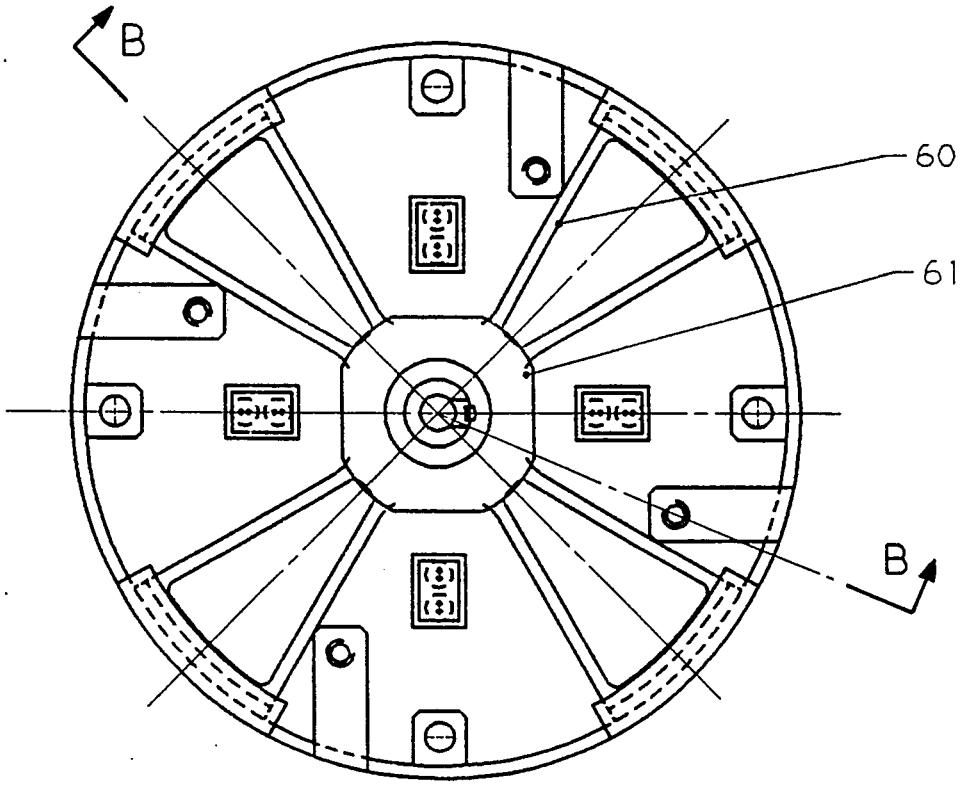
SECTION C-C - FIG 7
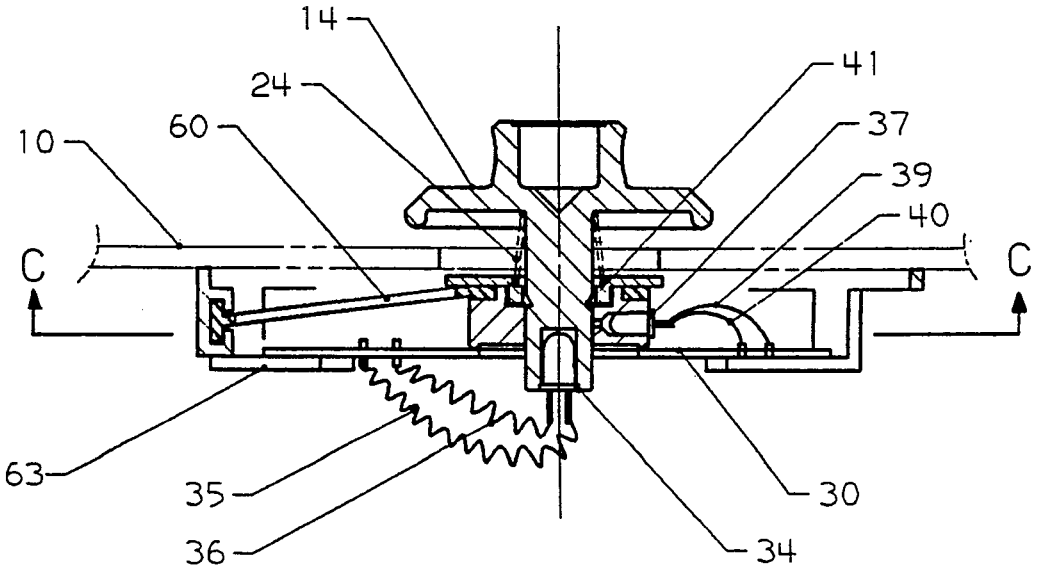
SECTION B-B - FIG 8

MANUALLY-OPERATED CONTROL DEVICE

This is a continuation of application Ser. No. 208,699 filed on June 20, 1988 now abandoned.

INTRODUCTION

This invention relates to a manually-operated control device which may be employed for inputting control information to a data processing apparatus. It is useful, for example, in controlling the position of a cursor on a display screen.

PRIOR ART

The prior art shows many examples of mechanical devices such as joysticks, mice etc. which are either intended to be or could be adapted to be used to control a cursor position on a display screen.

Many prior art joysticks use a plurality of mechanical switches (generally four) to detect the displacement of a handle from a neutral position in either direction along each of 2 mutually perpendicular axes. An example of such a device employing mechanical switches is shown in EP-A-83,421 (WICO Corporation). This discloses a handle, pivotally mounted by a flexible diaphragm, with four pairs of switch contacts arranged around the handle at 90 degrees to each other and below the pivot point. When the handle is displaced from its neutral position towards one pair of contacts, the opposite pair of contacts closes and the displacement of the handle is detected. If the handle is, instead, displaced diagonally between two pairs of contacts, then the two opposite pairs of contacts close and this alternative position of the handle is detected. In this way, 8 directions of movement of the handle can be detected. Also disclosed is a further pair of contacts disposed beneath the handle and arranged to be closed when a rod passed down the handle is depressed against the action of a spring. This action may be interpreted as a "fire" signal in a video game or, more generally, as acceptance of the position of a cursor on a display screen.

An alternative type of joystick is disclosed in NL 8004928 (Van der Molen). This is intended to control the supply current to the motors of a motorised wheelchair. It employs a pivotally-mounted handle adapted to translate an opaque disc in 2 perpendicular directions. It employs four light-emitting diodes (LEDs), each with an associated light detector, arranged at 90 degree intervals around the handle. When the handle is moved, the disc is moved into or out of the gap between each LED and its associated detector, such that the light path from each LED to its detector is either interrupted or clear. Signals from the detectors are used to determine the position of the handle. The outputs from the detectors vary continuously with varying position of the handle, rather than being simply on/off, so the joystick detects the extent to which the handle is moved away from its neutral position as well as the direction in which it is moved. The advantage of optical joysticks such as this is that they are not subject to degradation with use to the same extent as joysticks using potentiometers.

SUMMARY OF THE INVENTION

Prior art joysticks have therefore either employed electromechanical sensors, such as mechanical switches or potentiometers, and have consequently been subject to wear or they have employed optical sensing techniques requiring many light sources. Further, the joysticks employing optical techniques have tended to occupy greater depth than is desirable.

Accordingly, the present invention provides a manually-operated control device for controlling the position of a cursor on a display screen comprising a source of light, a plurality of detectors responsive to light from the source and a handle including transmission means for transmitting said light, the handle having a neutral position and a plurality of operative positions, wherein the handle is manually-movable from the neutral position to the operative positions to transmit a portion of the light from the source through the transmission means to one of the detectors, whereby the position of the handle may be measured by interrogation of the detectors.

Preferably, the transmission means includes a surface arranged to reflect light within the transmission means during transmission, thereby to decrease the overall height of the device.

This provides a device which occupies less height than would otherwise be the case since the transmitter and detectors can be almost coplanar. This is clearly an advantage for this device since it is desirable to locate it in a keyboard, alongside a bank of alphanumeric keys, where it is often important for both styling and ergonomic reasons that the height occupied should be as low as possible.

Preferably, the transmission means is formed in the shape of a mushroom, arranged to receive light from the source into a spigot forming the stem of the mushroom and to internally reflect the light such that it emanates from the transmission means as a circle of light.

Preferably, the plurality of detectors comprises four detectors, each detector being mounted in a support member at a different corner of a notional square.

This provides the facility for moving a cursor on a screen in the four directions up, down, left and right.

Preferably, the handle is translatably mounted in the support member such that the handle may be translatably moved within a predetermined region which is sufficiently extensive to permit each operative position to be attained and wherein in some of the operative positions the handle is arranged to receive light from the source and to transmit a portion of the light through said transmission means to two of the detectors simultaneously.

This can remove the expense of bearings required in the prior art arrangement of a pivotally-mounted joystick handle and, further, is likely to produce a device occupying reduced depth over this prior art. The ability to transmit light to more than one detector simultaneously means that the 45 degree positions of the handle can also be detected, if the detectors, handle and support member are suitably arranged.

Preferably, each detector has associated therewith a further detector such that, when the handle is moved along an axis from the neutral position to an operative position, further motion of the handle along the same axis causes light to be transmitted to the associated further detector.

This provides two levels of control in each of the four major directions: up, down, left and right. These may be interpreted for example by an attached data processing apparatus as slow and fast respectively or single-step and continuous movement respectively.

Preferably, it is also possible to achieve these two levels of control in the 45 degree positions. To permit this, the handle has to move further from the neutral position when it moves to these 45 degree positions than when it moves in the major directions.

Preferably, the device further comprises switch means, responsive to manual pressure exerted on the handle in a direction perpendicular to the plane of said notional square.

This provides the facility to fix the position of the cursor using the same control member and therefore the same hand of the operator as is used for moving the cursor. It is an advantage of this invention that the switch means is responsive to downward pressure exerted on any part of the handle; it is not necessary for the operator to find and press a "fire" button attached to the handle, as in the prior art. It is a further advantage of this invention that the switch means is opto-electronic and therefore has fewer moving parts liable to wear out.

DETAILED DESCRIPTION OF THE INVENTION

The invention will now be described by way of example with reference to the accompanying drawings, in which:

FIG. 2 is a plan view of an assembled version of the device of FIG. 1.

FIG. 3 is a cross-sectional view of the device of FIG. 2 taken on line A—A.

FIG. 4 is a cross-sectional view of the device of FIG. 2 taken on line B—B.

FIG. 5 is a cross-sectional view of the device of FIG. 3 taken on line C—C.

FIG. 7 is a view of the embodiment of FIG. 6 corresponding to the view of the first embodiment shown in FIG. 5

FIG. 8 is a view of the embodiment of FIG. 6 corresponding to the view of the first embodiment shown in FIG. 4.

Figure 1:
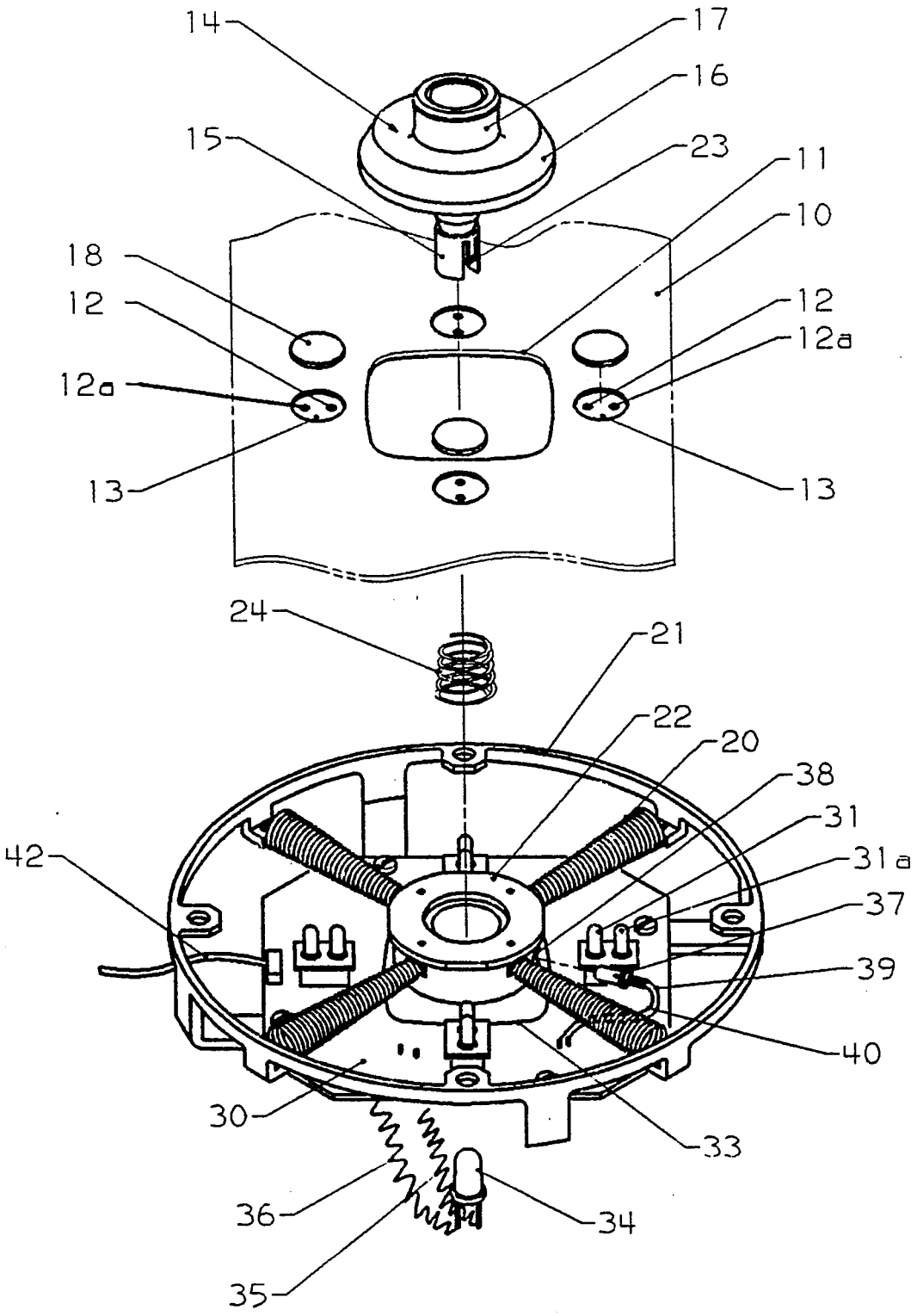
FIG. 1 is an exploded view of a first embodiment of the present invention.

Referring to FIG. 1, the top plate 10 of a keyboard has a large hole 11, four smaller holes 12 and a further four small holes 12*a*, grouped in depressions 13 around the hole 11 as shown in FIG. 2. Arranged to pass through hole 11 is a spigot 15 of a handle 14. This handle also includes a circular cap 16 and a finger grip 17, although if desired any convenient shape other than that shown could be used. This handle is formed of an infra-red light transparent plastics material such as polycarbonate or an acrylic resin. Ideally, the material and design of this handle are such that the handle may be fabricated by injection moulding.

Four discoidal filters 18 are provided which are bonded in place in the depressions 13. These filters permit the transmission of infrared light whilst absorbing and/or reflecting most of any visible or ultra-violet light incident on them. There are many filter materials which would be suitable for this application. One example is RG695, supplied by Schott, which absorbs 100% of incident light at 650 nm wavelength and 50% at 695 nm.

The remaining components of the device are situated beneath the top plate 10. These include a mechanism for centring the handle 14 in hole 11. This mechanism consists of four coil springs 20, each attached at one end to a support 21 which is in turn attached to the underside of top plate 10. The other end of each spring 20 is attached to a handle retaining ring 22; when assembled, spigot 15 passes through the large hole in ring 22 and is retained by latch 23 (see FIG. 3). The springs 20 are all similar in their mechanical characteristics and each is in tension in the arrangement shown, so that their combined action is to provide forces tending to centre the handle 14 in the hole 11. A further coil spring 24 is disposed around spigot 15 and between ring 22 and cap 16, such that, when assembled, the underside of cap 16 is biased to a position a small distance above the top plate 10. As an alternative to springs 20, it possible to employ leaf springs to provide the centring action to ring 22 and hence to handle 14.

Figure 6:
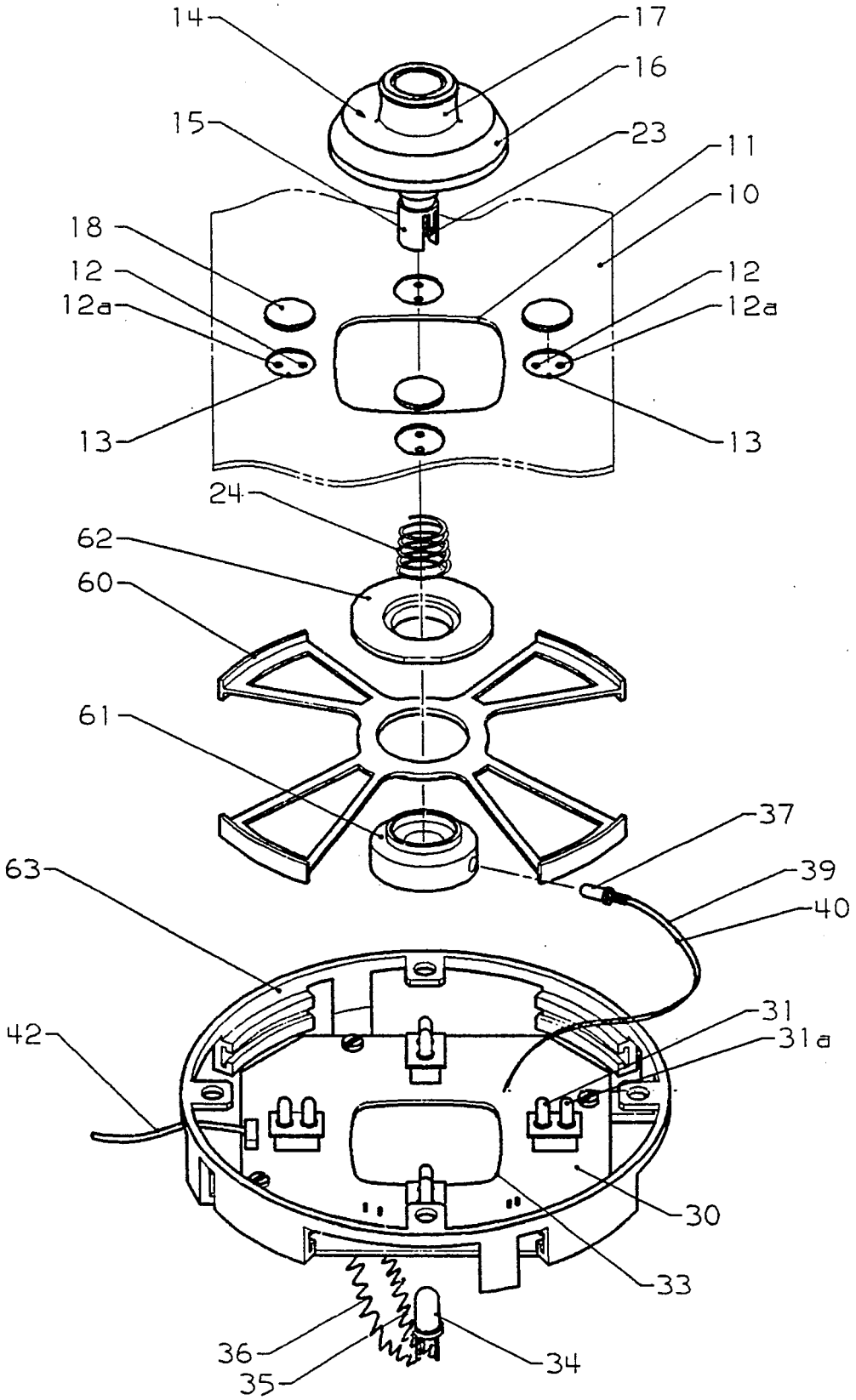
FIG. 6 is an exploded view of an alternative embodiment of the present invention.

A further alternative to coil springs 20 is shown in FIGS. 6,7 and 8. This employs an elastomeric member 60, which replaces springs 20, and a two part ring 61,62 which replaces ring 22. Ring parts 61,62 are pushed together, clamping elastomeric member 60 in the process, and held together either by glue or by virtue of being a tight fit one to the other. The remote ends of member 60 are retained in support 63, similar to support 21, by sliding into the four keyways shown in support 63.

This alternative centre-biasing method may be preferable to an embodiment employing coil springs since the elastomeric member 60 would provide desirable damping to the motion of the handle 14 and would provide greater reliability. This alternative would also be cheaper to produce in high volume, both in the cost of assembly and in the cost of parts, once the tooling costs of the elastomeric member had been amortized.

In either embodiment, a printed circuit board (pcb) 30 is attached to support 21 or 63, eg by screws or rivets. This pcb 30 carries four infra-red detectors 31 arranged with another four infra-red detectors 31*a* to match the smaller holes 12, 12*a* in top plate 10. The pcb 30 further carries electronic components (not shown) arranged to process signals received from the detectors 31, 31*a*. The pcb has a hole 33, similar in shape to hole 11 but somewhat smaller, to allow the end of the spigot 15 to pass through the pcb. Hole 33 need not be as large as hole 11 since it does not need to accommodate spring 24. The pcb has an area around hole 33 clear of any obstruction so that ring 22 may slide when it is laterally deflected away from its neutral position.

Infra-red transmitter 34 is electrically connected to pcb 30 by flying leads 35,36. Pcb 30 carries suitable drive circuitry for this transmitter. The transmitter is inserted into a cavity in the lower end of spigot 15, as shown in FIG. 3. It is retained in this position either by virtue of being a tight fit in the cavity or by a small amount of glue, applied around its edge prior to insertion.

A further infra-red detector 37 is retained in a hole 38 in the side of ring 22. This detector is electrically connected to pcb 30 by flying leads 39,40. As shown in FIG. 4, hole 38 narrows at its inner end but is nevertheless open to the spigot 15. A groove 41 is cut around the spigot 15 at a level selected to be a small distance above hole 38 when the handle is not in use.

In operation, infra-red light from transmitter 34 propagates up spigot 15 and is reflected by the conical surface 50 into the circular cap 16, as shown in FIG. 3. The light is again reflected, this time by frusto-conical surface 51, so that it is now directed downwards, through surface 52, towards the upper surface of top plate 10. This arrangement therefore produces a ring of infra-red light on top plate 10, the position of the ring being dependent on the lateral position of the handle 14. If desired, surface 52 may be curved to form a lens, as shown, in order to produce a more concentrated ring of light on top plate 10. Surfaces 50,51 may be silvered to increase the proportion of incident light they reflect, although this has not been found necessary in the present embodiment. Additionally, in the regions where total internal reflection is relied upon, the surface may be protected by a suitable coating, not shown. If it were desired to prevent the retention of foreign matter in the region of the finger grip 17, this grip could be replaced by a hemispherical cap covering the cap 16; this would also protect the reflective surfaces 50,51 from damage.

The finger grip 17 is grasped by an operator The handle is then laterally displaced by the operator in the direction of one of the pairs of holes 12,12*a*. The consequent change in the output of a detector 31 is detected by an electronic circuit (not shown) and is signalled to an attached data processing apparatus along cable 42. This signal is then used to move the position of a cursor up, down, left or right, depending on which detector is illuminated, ie on the direction in which the handle was moved.

Further displacement in the same direction causes the ring of light to be moved onto the adjacent hole 12*a* and its associated detector 31*a*. This is similarly signalled to the data processing apparatus and is used there to move the cursor more rapidly in the relevant direction. In particular, the cursor may move in single steps each time 12 is illuminated and continuously when 12*a* is illuminated or, alternatively, it may move slowly but continuously when 12 is illuminated and more rapidly when 12*a* is illuminated.

Clearly, if the ring of light were to be made wide enough, a third active position would be possible in which both holes 12 and 12*a* were illuminated, giving an intermediate position.

As an alternative, it is possible to use one continuous detector in place of each pair beneath holes 12,12*a*. This detector would be of a type suitable for giving a steadily increasing output voltage with increased distance along it at which the ring of light hits the detector. This would require a slot in place of holes 12,12*a* and would have the advantage that it would produce an output of amplitude roughly proportional to displacement of the handle from the neutral position. This could be useful in certain applications where an output proportional to handle displacement is desirable.

It will be noted from the drawings that the handle is not constrained to move only directly towards any detector from the centre. The handle can move anywhere in its plane as long as the spigot 15 is within the edges of holes 11 and 33. It is therefore possible to illuminate two holes 12 simultaneously by moving the handle in a direction midway between the two holes 12 concerned. This is useful since it provides the ability to move the cursor diagonally on the screen as well as up, down, left or right. It is also possible to illuminate two holes 12*a* simultaneously, to give accelerated diagonal movement. This is permitted by making the holes 11,33 approximately square as shown, rather than circular, so that the handle may travel further from the centre when it has to illuminate two holes 12*a* than when it has to illuminate only one. If it were desired to inhibit simultaneous illumination of two holes to inhibit movement of a cursor at 45 degrees, then it would be necessary to form holes 11,33 in the shape of a cross or similar, with each limb of the cross pointing towards one pair of holes 12,12*a*.

When the cursor has been moved across the screen to the desired position it is often desirable to indicate to the data processing apparatus that the current position is acceptable and that the data processing apparatus should take some further action (eg draw a line on the screen to or from the current cursor position). This device provides a facility for indicating this acceptance. It is achieved by pressing down on the handle 14 against spring 24. This causes the spigot 15 and the transmitter 34 to drop, while the ring 22 remains in position. This relative movement between spigot 15 and ring 22 causes the groove 41 in the spigot to align with the hole 38 and detector 37 in the ring 22.

Transmitter 34 transmits over a wide angle which includes the groove 41. The groove includes an angled surface arranged to reflect infra-red light outwards into hole 38 and thence detector 37. When the handle is not pressed down, the groove 41 and hole 38 are not aligned so the amount of light entering hole 38 is low. Consequently, the amount of light received by detector 37 increases when the handle is depressed and this increase is detected and signalled to the data processing apparatus, whereupon appropriate action is taken as mentioned above.

If the infra-red transmitter radiates over a very wide angle, such that it transmits light directly to hole 38 when the handle is not depressed, then it may be necessary to reduce the intensity of this directly transmitted light, either by ensuring that the sides of hole 38 absorb infra-red light very efficiently (so that only light travelling directly down hole 38 reaches the detector 37) or by making the sides of spigot 15 reflective to infra-red light (except at the groove 41), such that infra-red light may only escape from the spigot at groove 41 or into cap 16.

While the embodiment described employs an infra-red source and infra-red detectors, it will be understood that it would be quite possible to practise the invention utilising either visible light or ultra-violet light in place of infra-red light.

I claim:

1. A manually-operated control device for controlling the position of a cursor on a display screen comprising:

a source of light;

a plurality of detectors responsive to light from the light source;

a handle including transmission means for transmitting said light through the handle, the handle having a neutral position and a plurality of operative positions, wherein the handle is manually-movable from the neutral position to the operative positions to transmit a portion of the light from the source through the transmission means to one of the detectors, whereby the position of the handle may be measured by interrogation of the detectors; and each detector has associated therewith a further detector, such that, when the handle is moved along an axis from the neutral position to an operative position, further motion of the handle along the same axis causes light to be transmitted to the associated further detector.

2. A manually-operated control device as claimed in claim 1 wherein the transmission means is formed in the shape of a mushroom, arranged to receive light from the source into a spigot forming the stem of the mushroom and to internally reflect the light such that it emanates from the transmission means as a circle of light.

3. A manually-operated control device as claimed in claim 1 wherein the handle is mounted in a support member such that the handle may be moved within a predetermined region which is sufficiently extensive to permit each operative position to be attained and wherein in some of said operative positions the handle is arranged to receive light from the light source and to transmit a portion of said light through said transmission means to two of the detectors simultaneously.

4. A manually-operated control device as claimed in claim 1 further comprising switch means responsive to manual pressure exerted on said handle in a direction parallel to said handle.

5. A manually-operated control device as claimed in claim 4 wherein said switch means comprises an additional detector responsive to said light from said source and means responsive to said manual pressure for directing a portion of said light to said additional detector.

6. A manually-operated control device as claimed in claim 1 wherein each of said plurality of detectors has a filter over its active region to reduce the intensity of background radiation reaching the detector over a range of frequencies distinct from those of the light produced by said source.

7. A manually-operated control device as claimed in claim 1 wherein said light is infra-red.

* * * * *